US009297609B2

(12) United States Patent
Burt

(10) Patent No.: US 9,297,609 B2
(45) Date of Patent: Mar. 29, 2016

(54) FIREARM WITH FORWARD GRIP ATTACHMENT SYSTEM

(71) Applicant: RA Brands, L.L.C., Madison, NC (US)

(72) Inventor: Eric C. Burt, Boulder, CO (US)

(73) Assignee: RA Brands, L.L.C., Madison, NC (US)

( * ) Notice: Subject to any disclaimer, the term of this patent is extended or adjusted under 35 U.S.C. 154(b) by 52 days.

(21) Appl. No.: 13/800,219

(22) Filed: Mar. 13, 2013

(65) Prior Publication Data

US 2014/0068987 A1 Mar. 13, 2014

Related U.S. Application Data

(60) Provisional application No. 61/743,890, filed on Sep. 13, 2012.

(51) Int. Cl.

| | |
|---|---|
| ***F41A 21/48*** | (2006.01) |
| ***F41C 23/16*** | (2006.01) |
| ***F41A 3/84*** | (2006.01) |
| *F41A 3/66* | (2006.01) |
| *F41C 23/04* | (2006.01) |

(52) U.S. Cl.

CPC . *F41C 23/16* (2013.01); *F41A 3/84* (2013.01); *F41A 21/48* (2013.01); *F41A 3/66* (2013.01); *F41C 23/04* (2013.01)

(58) Field of Classification Search

CPC ..... F41A 21/00; F41A 21/48; F41C 23/00; F41C 23/16

USPC ..... 42/90, 75.03, 96, 71.01

See application file for complete search history.

(56) References Cited

U.S. PATENT DOCUMENTS

| | | | |
|---|---|---|---|
| 2,424,194 | A | 7/1947 | Sampson et al. |
| 2,466,017 | A | 4/1949 | Farber |
| 3,827,172 | A | 8/1974 | Howe |
| 4,383,384 | A | 5/1983 | Fox |
| 5,826,363 | A | 10/1998 | Olson |

(Continued)

FOREIGN PATENT DOCUMENTS

| | | |
|---|---|---|
| CA | 117291 | 1/2008 |
| DE | 1225517 | 9/1966 |

(Continued)

OTHER PUBLICATIONS

Lewis, Jack & Steele, David E.; The Gun Digest Book of Assault Weapons, (5th ed. 2000); Krause Publications; Iola, Wisconsin; pp. 68-69, 125.

(Continued)

*Primary Examiner* — Jonathan C Weber

(74) *Attorney, Agent, or Firm* — Womble Carlyle Sandridge & Rice, LLP

(57) ABSTRACT

A hand guard attachment system for releasably attaching a hand guard to a firearm is disclosed herein. The system includes the hand guard having a proximal end configured to engage a forward end of a receiver of the firearm. The system further includes a tensioning assembly configured to interface between the hand guard and the forward end of the firearm. The tensioning assembly is further configured to selectively maintain an engaged position between the hand guard and the firearm such that the hand guard is releasably attached to the firearm without interfering with, or requiring removal of, the barrel and/or barrel nut connected to the receiver.

9 Claims, 13 Drawing Sheets

(56) References Cited

U.S. PATENT DOCUMENTS

| | | | | |
|---|---|---|---|---|
| 6,490,822 | B1 | 12/2002 | Swan | |
| 6,564,492 | B2 | 5/2003 | Weldle et al. | |
| 6,694,660 | B1 | 2/2004 | Davies | |
| 6,839,998 | B1 | 1/2005 | Armstrong | |
| D537,901 | S | 3/2007 | Elkaim | |
| D606,614 | S | 12/2009 | Fitzpatrick et al. | |
| 7,716,865 | B2 | 5/2010 | Daniel et al. | |
| 7,770,317 | B1 | 8/2010 | Tankersley | |
| D641,825 | S | 7/2011 | Gridelet | |
| 7,975,595 | B2 | 7/2011 | Robinson et al. | |
| 8,046,949 | B1 * | 11/2011 | Daniel | 42/75.02 |
| 8,061,072 | B1 | 11/2011 | Crose | |
| 8,141,285 | B2 | 3/2012 | Brown | |
| 8,191,300 | B2 | 6/2012 | Daniel | |
| 8,276,304 | B2 | 10/2012 | Samson et al. | |
| 8,336,243 | B2 | 12/2012 | Langevin et al. | |
| 2006/0277810 | A1 * | 12/2006 | Leitner-Wise | 42/75.03 |
| 2009/0100734 | A1 | 4/2009 | Swan et al. | |
| 2010/0319231 | A1 * | 12/2010 | Stone et al. | 42/71.01 |
| 2011/0126443 | A1 * | 6/2011 | Sirois | 42/90 |
| 2011/0252625 | A1 * | 10/2011 | Daniel | 29/525.01 |
| 2012/0180354 | A1 | 7/2012 | Sullivan et al. | |
| 2012/0186123 | A1 | 7/2012 | Troy et al. | |
| 2012/0246989 | A1 * | 10/2012 | Troy | 42/71.01 |
| 2012/0324775 | A1 * | 12/2012 | Troy et al. | 42/71.01 |
| 2013/0047832 | A1 | 2/2013 | Hochstrate et al. | |
| 2013/0276341 | A1 * | 10/2013 | Wells et al. | 42/71.01 |

FOREIGN PATENT DOCUMENTS

| | | | |
|---|---|---|---|
| DE | 10 2005 054917 | A1 | 5/2007 |
| WO | WO 2014-031593 | A2 | 2/2014 |

OTHER PUBLICATIONS

International Search Report dated Feb. 26, 2014 for International Patent Application No. PCT/US2013/055710 filed Aug. 20, 2013.

Written Opinion dated Feb. 26, 2014 for International Patent Application No. PCT/US2013/055710 filed Aug. 20, 2013.

Color Image; Firearm carbine ACR 8 ss; 1 page; Mar. 8, 2013; http://homefront/wikia.com/wiki/File:Firearm__carbine__ACR__8__ss.jpg.

Barry, Max; NationStates; Awac States Log; 12 pages; Mar. 8, 2013; http://forum.nationstates.net/viewtopic.php?f=23&t=72464 &start=0.

Zimba, Jeff W.; Another Tactical Upgrade from MGI Military: The QCB Upper Receiver for the AR-15/M16/M4; The Small Arms Review, vol. 8 No. 3; pp. 37-40; Dec. 2004.

* cited by examiner

FIREARM WITH FORWARD GRIP ATTACHMENT SYSTEM

CROSS REFERENCE TO RELATED APPLICATIONS

The present Patent Application is a formalization of previously filed, co-pending United States Provisional Patent Application Ser. No. 61/743,890, filed Sep. 13, 2012, entitled "Firearm with Forward Grip Attachment System" by the inventor named in the present Application, and of previously filed, co-pending United States Provisional patent Application Ser. No. 61/743,040, filed Aug. 24, 2012, also entitled "Firearm with Forward Grip Attachment System. This Patent Application claims the benefit of the filing dates of each of these cited Provisional Patent Applications according to the statutes and rules governing provisional patent applications, particularly 35 U.S.C. §119(a)(i) and 37 C.F.R. §1.78(a)(4) and (a)(5). The specification and drawings of the Provisional Patent Applications referenced above are specifically incorporated herein by reference as if set forth in their entirety.

FIELD OF THE INVENTION

The present invention generally relates to firearms and features thereof, and in particular, to a firearm including systems for engaging and mounting a forward grip or hand guard to the firearm, and for slidably mounting a stock assembly to the receiver of the firearm.

BACKGROUND OF THE INVENTION

In many semiautomatic and/or fully automatic firearms driven by gas operating systems, the barrels of such firearms typically are surrounded by a hand guard or forward grip portion with the barrel generally mounted in a "free floating" arrangement out of contact with the hand guard. The hand guard or forward grip portion enables the operator to grip the firearm securely along the barrel portion thereof, without coming into contact with the barrel, which can become extremely hot during the firing of the weapon. Additionally, the hand guard can provide for the mounting of rails, lights and other accessories along the firearm.

Typically, many firearm hand guards have been designed to be removable so as to enable access to the barrel and/or gas system of the firearm for purposes of cleaning and/or replacement of the barrel and/or gas system components of the firearm. Such removable hand guards often are fastened to the barrel nut and/or upper receiver of the firearm with screws or other, similar fasteners. Such fasteners can, however, present difficulties in removing and/or tightly securing the hand guard to the upper receiver, typically requiring tools, such as wrenches, screwdrivers, etc. be readily available to the shooter in order to remove the screws, or other fasteners. In addition, it is often necessary to remove the barrel nut and/or the entire barrel assembly to remove such hand guards for change-out or replacement of the hand guard.

Accordingly, a need exists for an attachment system for attaching a hand guard or forward grip to a receiver of a firearm that address the foregoing and other related and unrelated problems in the art.

SUMMARY OF THE INVENTION

According to an aspect of the disclosure, a firearm is disclosed herein. The firearm comprises an upper receiver, a barrel coupled to the upper receiver, and a hand guard releasably attached to the upper receiver and floating from the barrel. The hand guard comprises a proximal end configured to engage an outer surface of the upper receiver. A tensioning assembly is configured to interface between the hand guard and the receiver, and is further configured to selectively maintain an engaged position between the hand guard and the firearm such that the hand guard is releasably attached to the firearm.

According to another aspect of the disclosure, a hand guard attachment system for releasably attaching a hand guard to a firearm is disclosed herein. The system includes the hand guard having a proximal end configured to engage a forward end of a receiver of the firearm. The system further includes a tensioning assembly configured to interface between the hand guard and the forward end of the firearm. The tensioning assembly is further configured to selectively maintain an engaged position between the hand guard and the firearm such that the hand guard is releasably attached to the firearm without interfering with, or requiring removal of, the barrel and/or barrel nut connected to the receiver.

According to yet another aspect of the disclosure.

Various additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

Various features, advantages and aspects of the present invention may be set forth or apparent from consideration of the following detailed description, when taken in conjunction with the accompanying drawings. Moreover, it will be understood that the accompanying drawings, which are included to provide a further understanding of the present disclosure, are incorporated in and constitute a part of this specification, illustrate various aspects, advantages and benefits of the present disclosure, and together with the detailed description, serve to explain the principles of the present disclosure. In addition, those skilled in the art will understand that, according to common practice, various features of the drawings discussed below are not necessarily drawn to scale, and that dimensions of various features and elements of the drawings may be expanded or reduced to more clearly illustrate the embodiments of the present disclosure.

DESCRIPTION OF THE INVENTION

Figure 1:
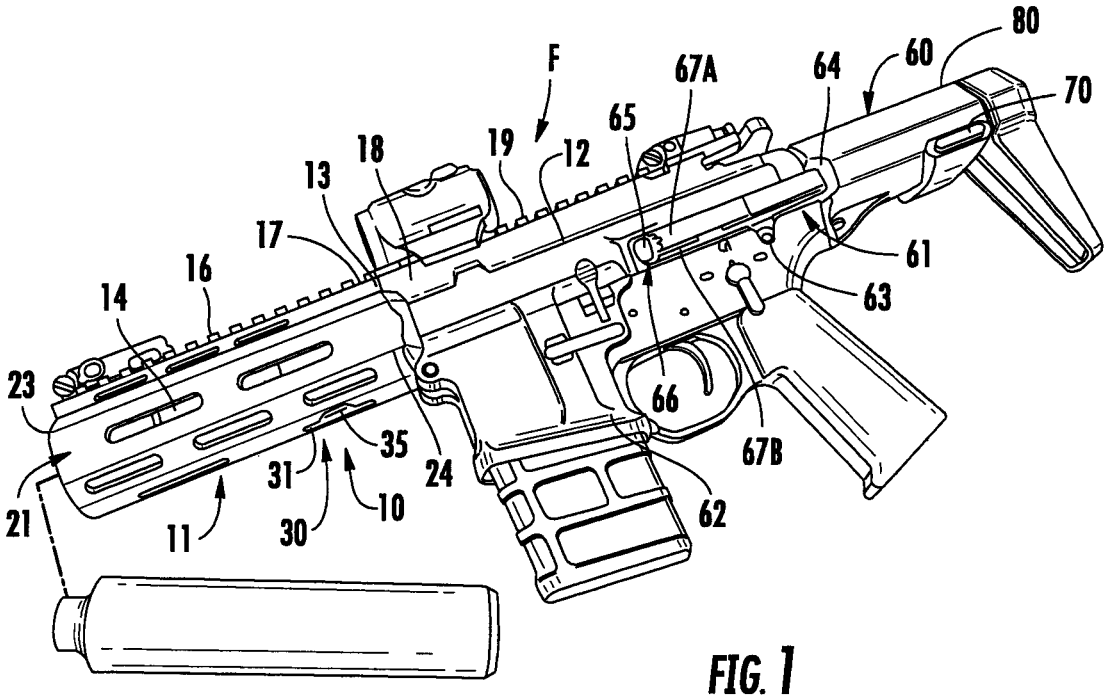
FIG. 1 is a perspective illustration showing one example embodiment of a firearm including a hand guard attachment system and stock rail guide system, according to embodiments of the disclosure.

Referring now to the drawings in which like numerals indicate like parts throughout the several views, the present invention generally is directed to firearms including systems for the attachment of various accessories or components of the firearm to an upper receiver, frame or chassis thereof, as illustrated in FIGS. 1-10D. In particular, in one embodiment, the present invention includes a hand guard attachment system 10 for attaching a hand guard or forward grip 11 to an upper receiver 12 of a firearm F (FIG. 1) with the barrel 14 of the firearm received therein in a "floating" engagement. As illustrated in FIG. 1, the firearm F can include a semiautomatic or automatic rifle or other, similar firearm, although it will be understood by those skilled in the art that the present invention further can be adapted for use with various other types of firearms, including other types of rifles, shotguns and/or other long guns, as well as various types of handguns.

Figure 2:
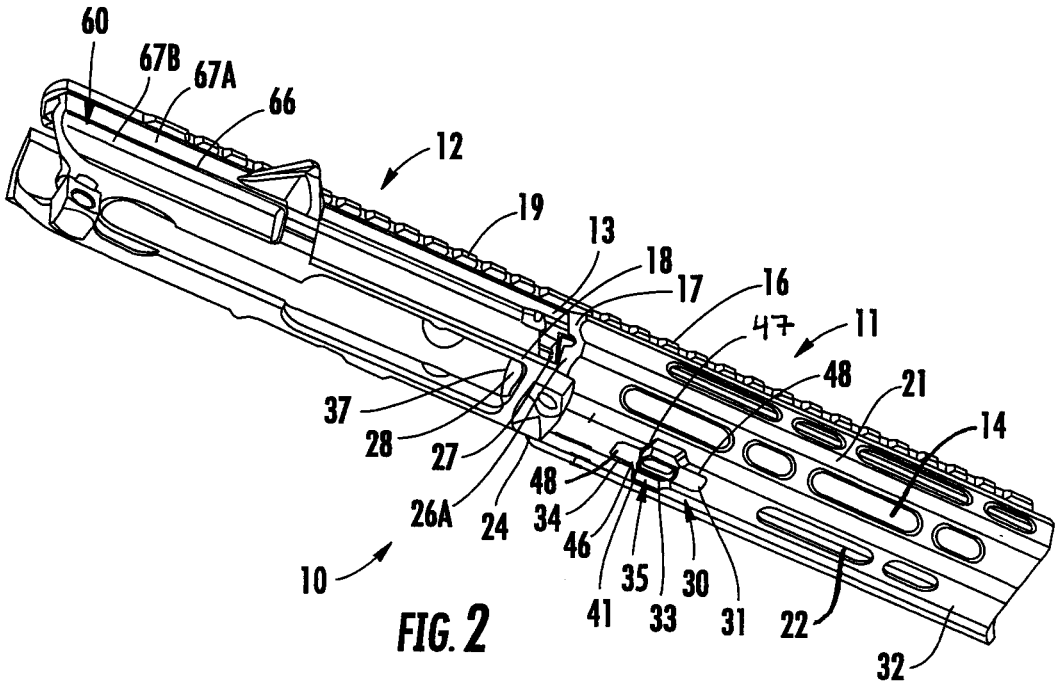
FIG. 2 is a perspective illustration of an upper receiver and hand guard joined using the hand guard attachment system, according to embodiments of the disclosure.

As indicated in FIGS. 1-2, the hand guard attachment system 10 according to the principles of the present invention is designed to securely and efficiently mount the hand guard or forward grip 11 to the upper receiver 12 of the firearm F in a secure, substantially rigid alignment abutting against a forward end 13 of the upper receiver 12, while still enabling the simple and efficient disconnection of the hand guard 11 from the upper receiver 12 as needed, without requiring removal of the barrel or barrel nut and without necessarily requiring special tools or operations for the disconnection and remounting of the hand guard to the upper receiver.

In addition, while the hand guard 11 is illustrated in the figures as generally having a substantially cylindrical construction and/or including an integrated Piccatiny rail 16 formed therealong, which rail can be aligned with and its rear or proximal end 17 placed into mating contact with the forward or proximal end 18 of a corresponding Piccatiny mounting rail 19 formed along or mounted to the upper receiver 12, it will be understood by those skilled in the art that the hand guard 11 and be formed in a variety of shapes or configurations. The hand guard further can include or have mounted thereto various different accessories or features, including multiple rails arranged at various locations about the body 21 of the hand guard 11, and/or further can include a series of slots or vent openings 22 to enable air to pass through the hand guard.

Figure 3A:
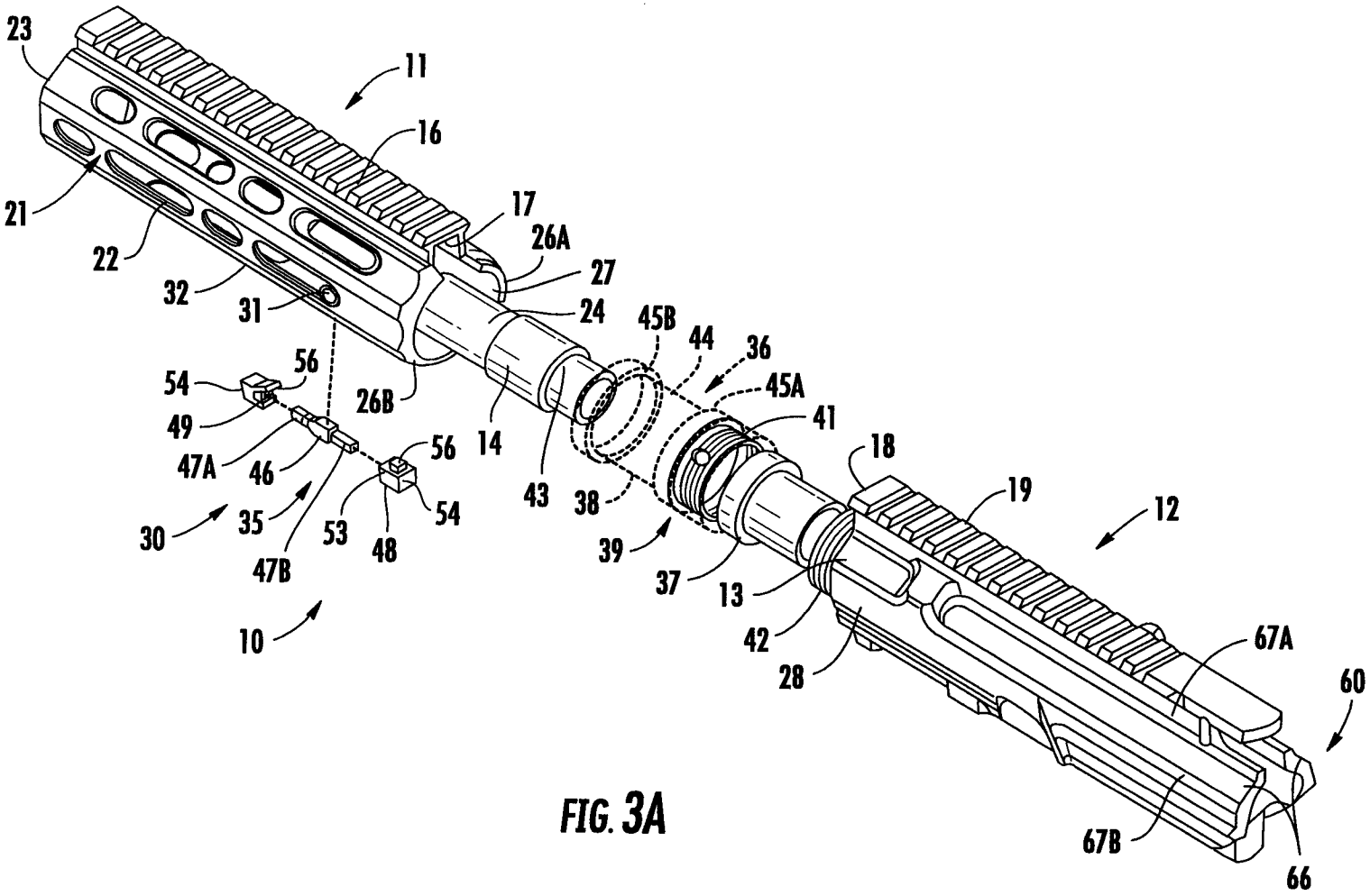
FIG. 3A is an exploded perspective illustration of the hand guard and upper receiver and the attachment system of FIG. 2.
Figure 3B:
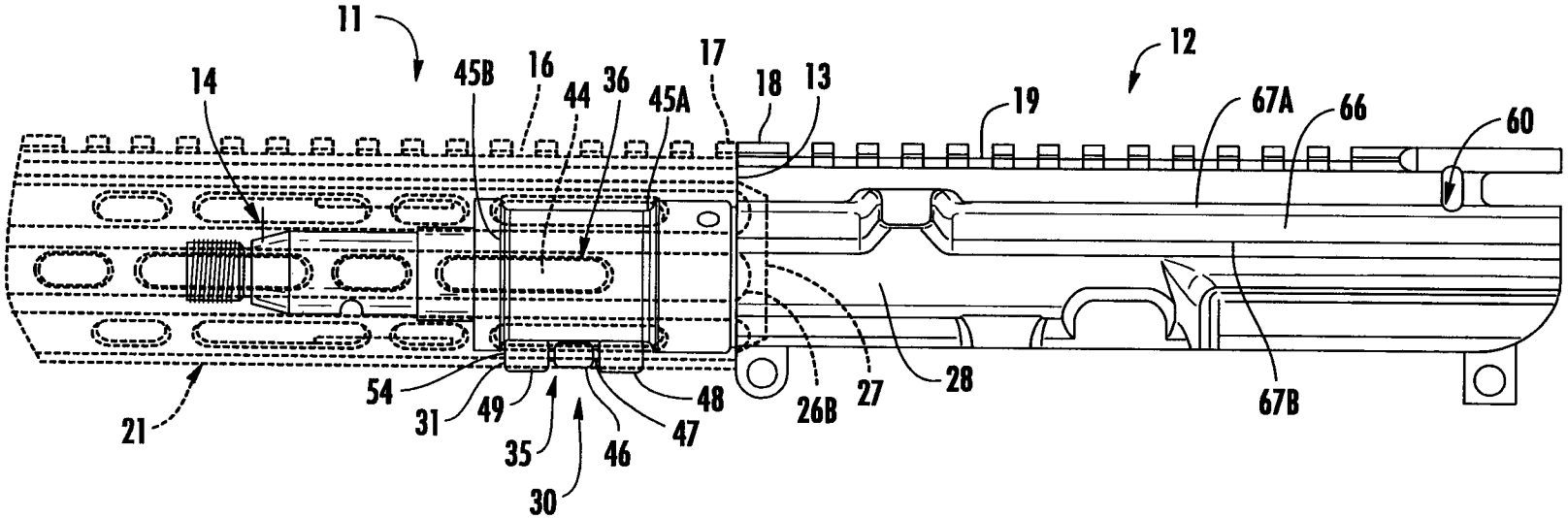
FIG. 3B is a side elevational view of the upper receiver and hand guard of FIG. 2, with portions of the hand guard being schematically illustrated to illustrate the engagement of the attachment system between the hand guard and barrel nut.
Figure 4A:
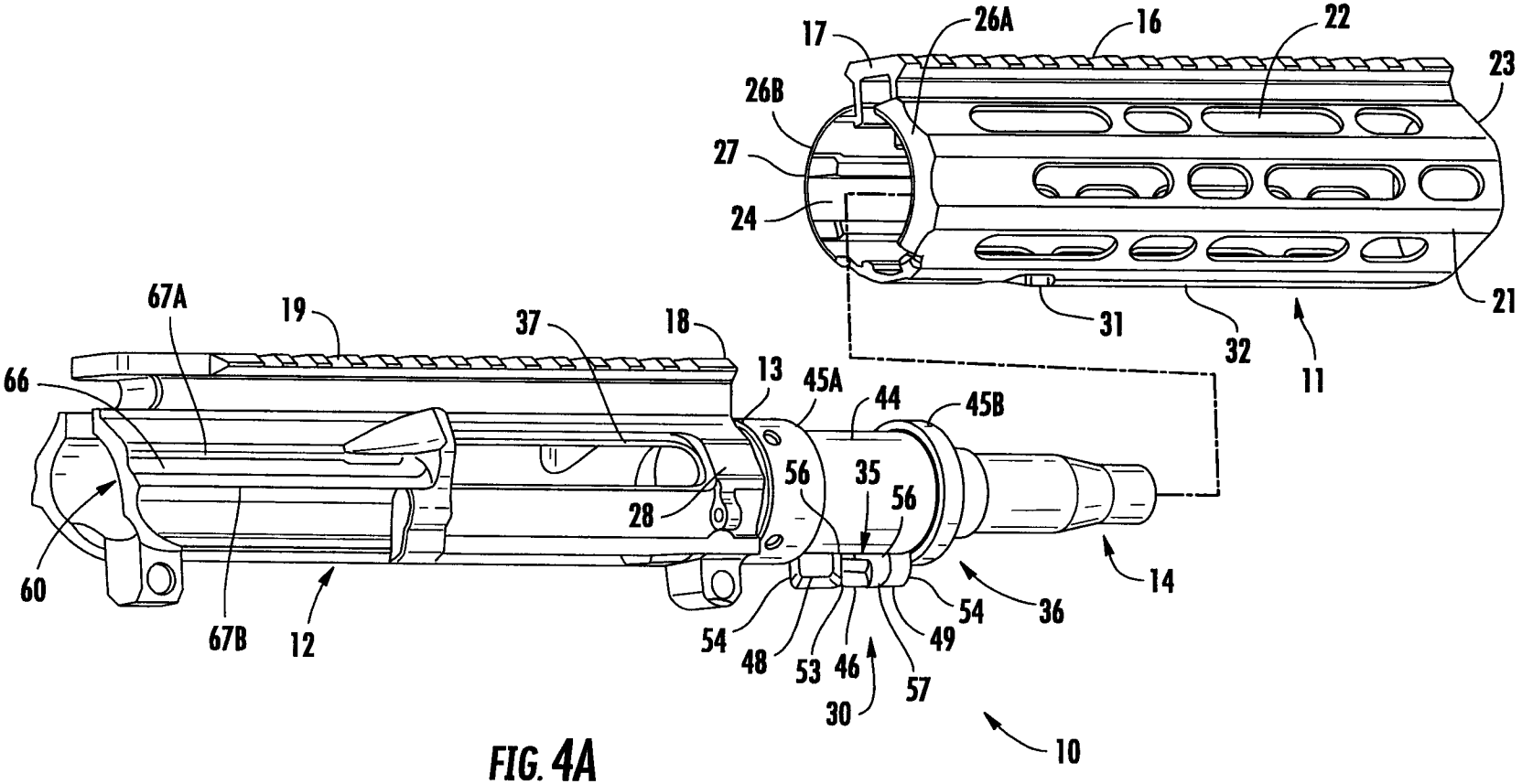
FIG. 4A is a perspective illustration of the hand guard and upper receiver of FIG. 2, with the hand guard broken away to illustrate the features of the attachment system.
Figure 4B:
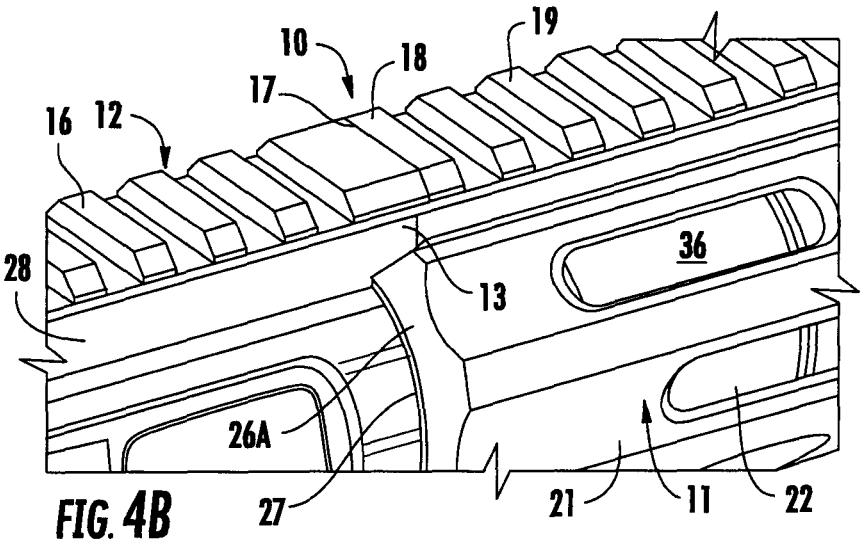
FIG. 4B is a perspective illustration showing the resilient/frictional engagement between the interfacing tabs of the hand guard and the receiver, according to embodiments of the disclosure.

As generally illustrated in FIGS. 2-3A and 4A, the body 21 of the hand guard 11 generally will substantially enclose the barrel 14 and will include an open, first, forward or distal end 23 and a second, rearward or proximal end 24 that engages and bears against the forward end 13 of the upper receiver 12 in tight abutting contact therewith. The proximal end 24 of the hand guard further can engage the forward end 13 of the upper receiver 12 in a frictional or bearing engagement, as illustrated in FIG. 4B. As further shown in FIGS. 3A and 4B, the proximal end 24 of the hand guard 11 generally can be formed with rearwardly extending interfacing tabs or projections 26A and 26B (FIG. 3A). These interfacing tabs are generally shown as substantially semicircular sections or portions of the body 21 of the hand guard that extend rearwardly past the proximal end 17 of the rail 16 of the hand guard. The interfacing tabs 26A and 26B can include inwardly projecting edges 27 having an inner diameter that can be less than the outer diameter of the hand guard and which can be approximately equal to or slightly less than the outer diameter of the forward end 13 of the upper receiver 12.

The interfacing tabs 26A and 26B further generally will have some resilience so as to enable the forward end 13 of the upper receiver to be received/inserted therebetween and which resilience will tend to urge the edges 27 of the interfacing tabs 26A and 26B into resilient, biased or frictional engagement against a frontal edge or portion of the outer side wall 28 of the upper receiver adjacent its forward end as illustrated in FIGS. 1 and 4B. This frictional or biased engagement between the interfacing tabs of the hand guard and the upper receiver help guide the hand guard into alignment with the upper receiver, so that the ends of the corresponding ends/edges 17/18 of the rail 16 of the hand guard and corresponding rail 19 of the upper receiver are aligned and are brought into aligned, mating contact. The engagement between the hand guard and upper receiver provided by the interfacing tabs further can hold the hand guard in an engaged position against the forward end of the upper receiver as the firearm is manipulated for securing the hand guard to the upper receiver by a tensioning assembly 30 of the hand guard attachment system 10, as illustrated in FIGS. 1-3B, 5A-5B and 7-8C.

Figure 8A:
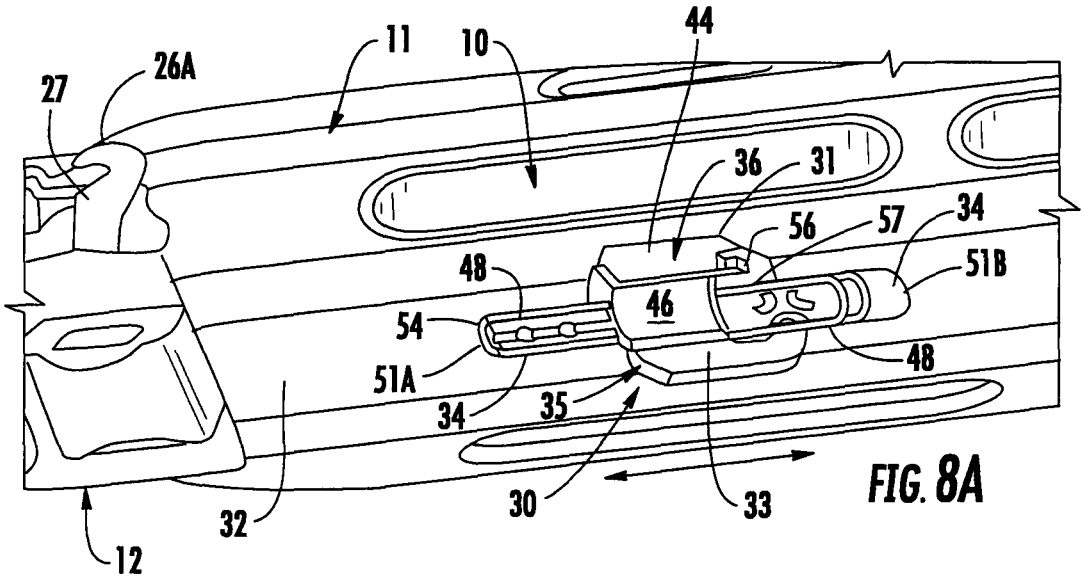
FIGS. 8A-8C sequentially illustrate the engagement of the turnbuckle mechanism within the hand guard for securing the hand guard to the barrel nut and the receiver of the firearm, according to embodiments of the disclosure.
Figure 8B:
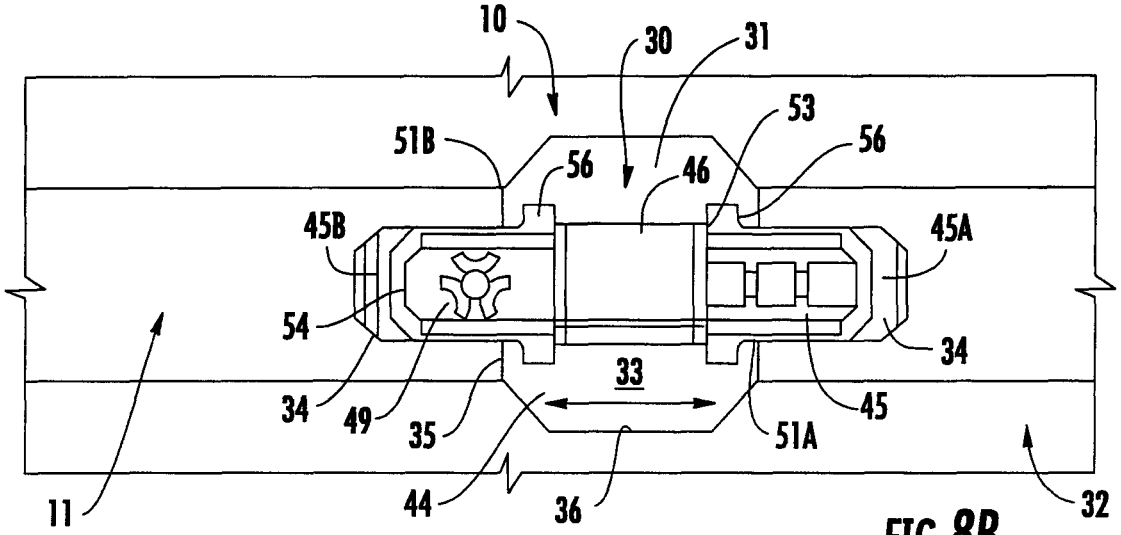
Figure 8C:
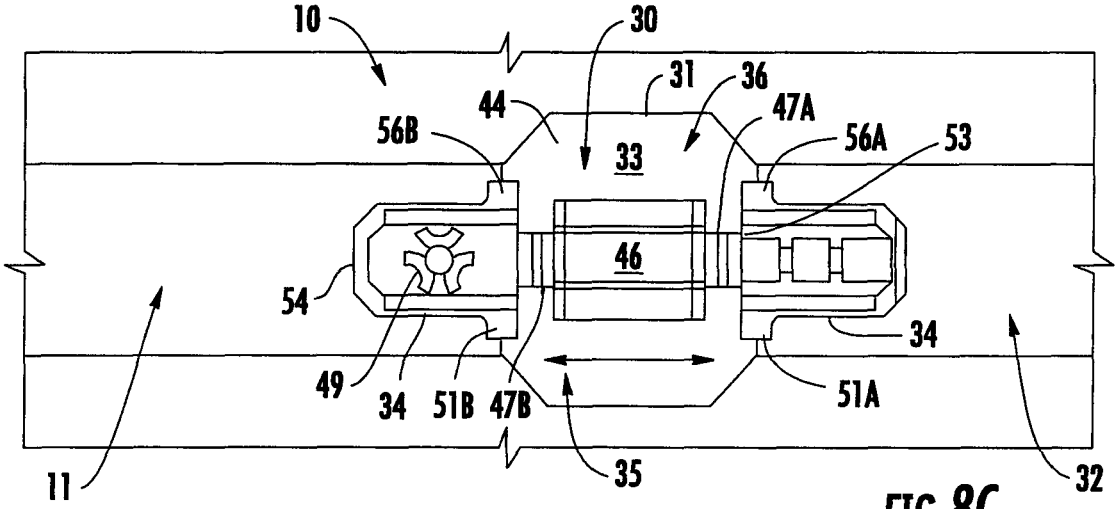

The hand guard attachment system 10 further generally will include a slotted opening 31 formed along an underside surface 32 of the hand guard 11 (FIG. 2). In one embodiment, as shown in FIGS. 8A-8C, the slotted opening can include an enlarged central opening 33 with sidewise openings of a reduced size projecting from upstream and downstream ends thereof, although various other opening configurations also can be used. The slotted opening 31 will receive the tensioning assembly 30 therein and provide a point or area of engagement for the tensioning assembly, here shown in one embodiment as comprising a turnbuckle mechanism 35 between the hand guard 11 and a barrel nut 36 for connecting the barrel to the upper receiver.

As generally illustrated in FIGS. 3A-4A and 5A-6, the upper receiver 12 generally is connected to the barrel 14 of the firearm by barrel nut 36, which can receive a barrel extension 37 therein. As shown in FIG. 3A, the barrel nut 36 generally includes a substantially cylindrical body 38 having a rear or proximal end 39 including a series of threads 41 formed thereabout for engaging a corresponding set of threads 42 formed about the forward end of the upper receiver as indicated in FIG. 3A to couple the barrel to the upper receiver. The barrel 14 further typically will include a series of threads 43 that engage corresponding threads within the barrel nut 36 for drawing the barrel into tight, sealed engagement with the upper receiver upon tightening of the barrel nut. The barrel nut further can include a recessed portion or area 44 having upstream and downstream edges 45A/45B of a greater diameter than the recessed portion 44.

As further indicated in FIGS. 2-4A and 5A-5B, once the barrel has been secured to the upper receiver, the hand guard 11 can be placed thereover, with its tabs 26A and 26B engaging the forward end 13 of the upper receiver so as to place the hand guard and upper receiver in aligned, engaging contact. The turnbuckle mechanism 35 of the present embodiment of the tensioning assembly 30 thereafter is inserted through the slotted opening 31 formed along the underside 32 portion of the hand guard body 21, as indicated in FIGS. 1, 2, 5A and 8A-8C.

Figure 6:
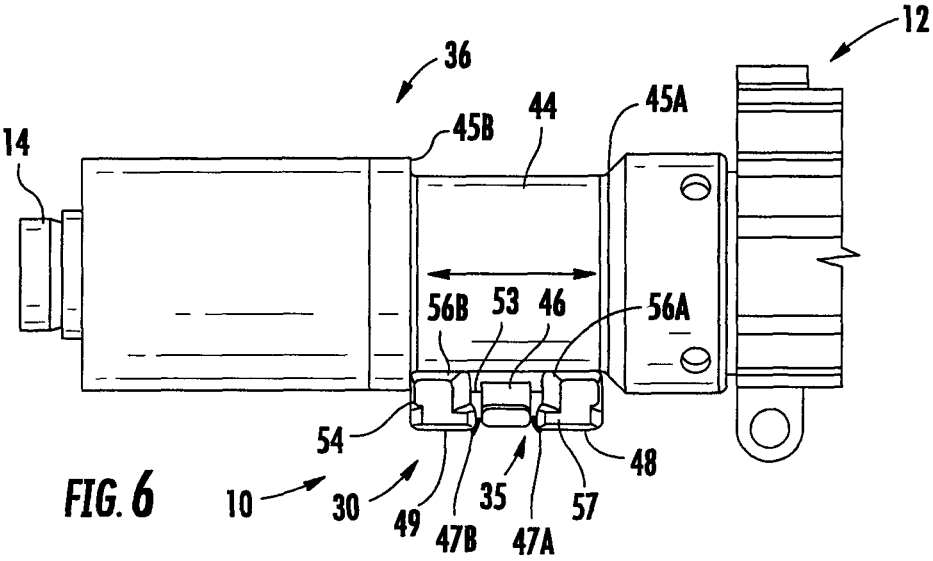
FIG. 6 is a side elevational view showing the engagement of the tensioning assembly of the hand guard attachment system with the barrel nut, according to embodiments of the disclosure.
Figure 7:
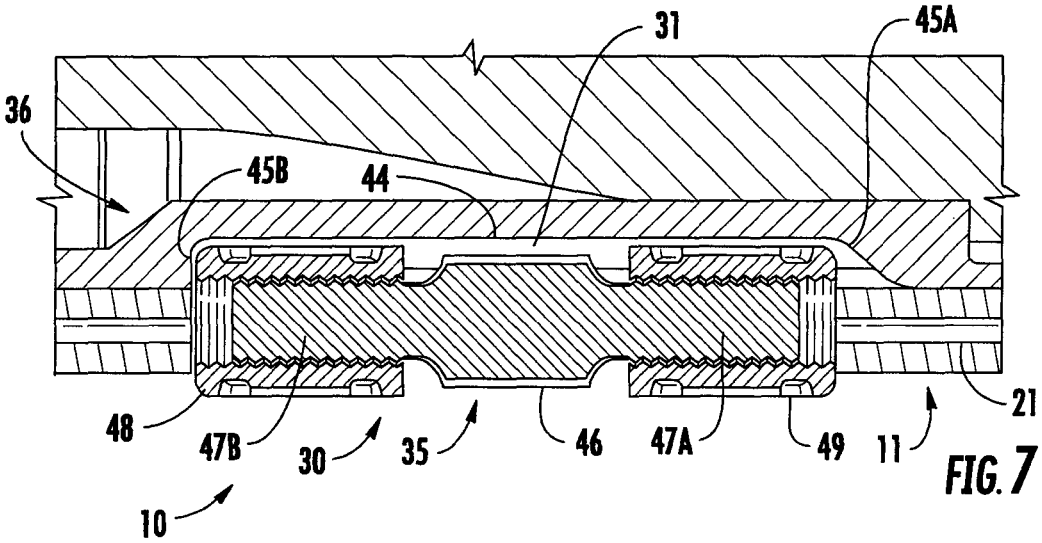
FIG. 7 is a cross-sectional view of a tensioning assembly of the hand guard attachment system, comprising a turnbuckle mechanism, illustrating the engagement and application of a linear force on the barrel nut and the hand guard while being locked in place between the barrel nut outer diameter and the hand guard inner diameter, according to embodiments of the disclosure.
Figure 5A:
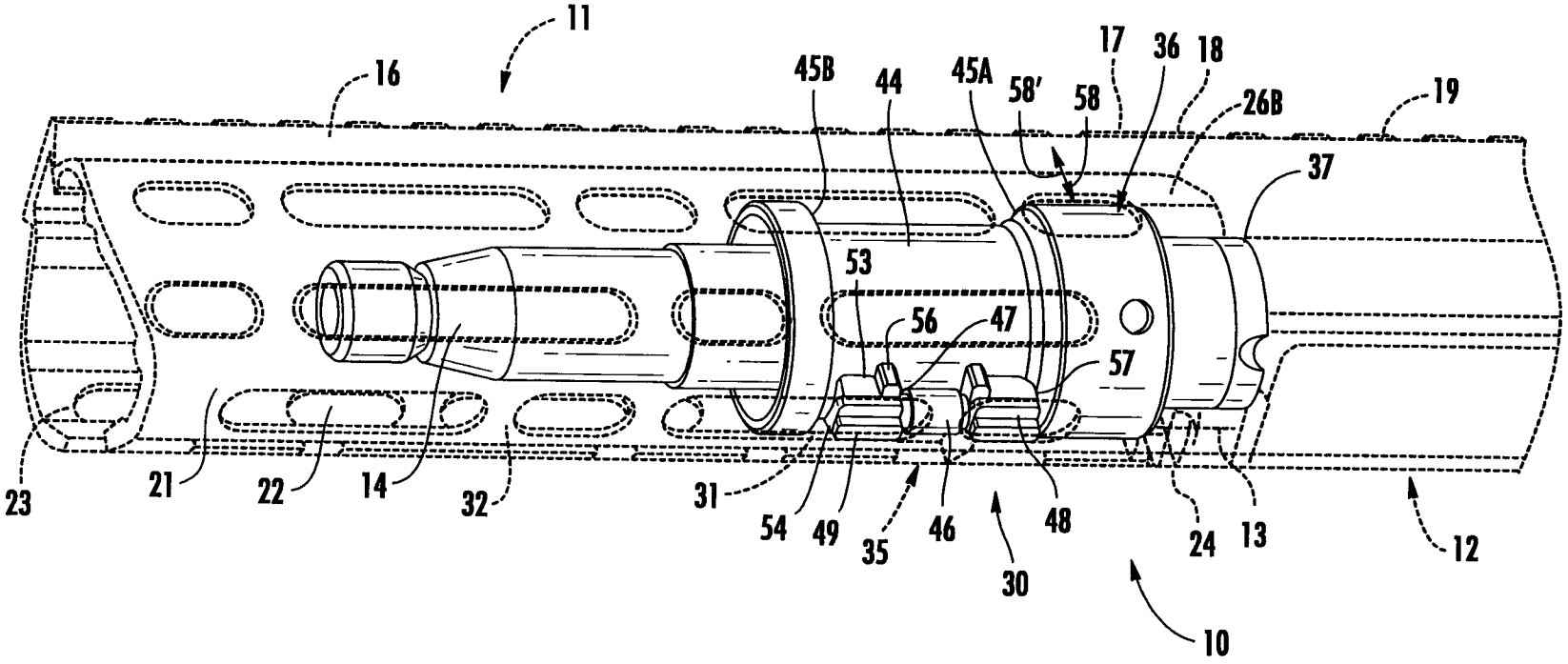
FIGS. 5A and 5B are perspective illustrations of a tensioning assembly of the hand guard attachment system engaged between the hand guard and barrel nut, with the hand guard being shown schematically, according to embodiments of the disclosure.
Figure 5B:
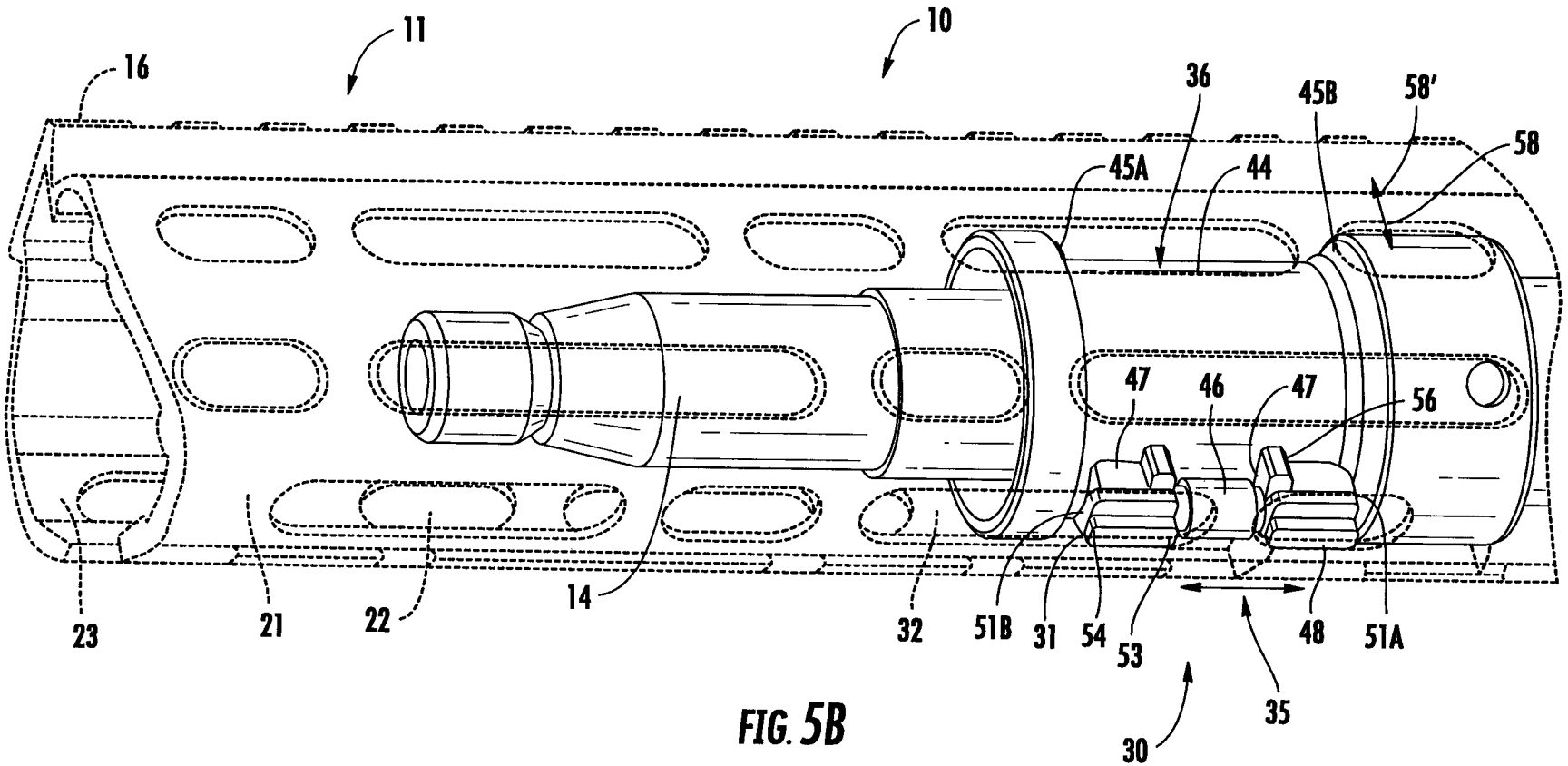

The turnbuckle mechanism 35 generally includes a rotatable spindle or central portion 46 having threaded shanks 47A and 47B extending from the opposite sides of the central portion 46 as shown in FIGS. 3A and 7. Engaging tabs 48 and 49 are mounted along the threaded shanks 47A and 47B and are moveable toward and away from each other by the rotation of the central spindle portion 46 of the turnbuckle mechanism 35 so as to move the engaging tabs into tight, frictional engagement with the barrel nut and against edges 51A/B of the slotted opening 31 of the hand guard 11, as generally illustrated in FIGS. 5A-5B and 7. Each of the engaging tabs 48 and 49 generally will include an elongated body 52 threadably attached along their proximal ends 53 to the threaded shanks 47 and with their distal ends 54 engaging upstream and downstream edges 45A/45B of the barrel nut recess 44, as shown in FIG. 6.

In addition, as shown in FIGS. 6 and 8B-8C, each of the engaging tabs 48 and 49 further includes lateral projections 56A/56B that extend laterally outwardly and away from the bodies 52 of the engaging tabs 48/49. These projections 56A/56B generally are formed with gaps 57 (FIG. 6) therebelow and will tend to ride upwardly and over the inner surface of the hand guard body along the edges 51A/51B of the slotted opening 31, as generally indicated in FIGS. 8A-8C. As a result, as the turnbuckle mechanism is engaged and its spindle rotated, the engaging tabs 48 and 49 are urged into tight, frictional engagement with the upstream and downstream edges 45A/45B of the barrel nut recess 44, the lateral projections 56A/56B will engage and move between the inner wall of the hand guard and the barrel nut, causing the hand guard to be drawn against the barrel nut as indicated at arrows 58/58' in FIGS. 5A-5B. This action and engagement of the turnbuckle mechanism between the barrel nut and the hand guard thus applies a linear force between the barrel nut and the hand guard while further locking the hand guard in place vertically.

As indicated in FIGS. 8A-8C, the spindle 46 of the turnbuckle mechanism 35 generally can be manipulated manually by a user. However, the spindle also can be configured so as to be engagable by a wrench, pliers or other tool as needed or desired. For example, the spindle can include a hexagonal or other, similar construction having a series of faces against which a wrench can engage and bear to help tighten the turnbuckle as needed, or can include openings adapted to receive a pin, lever, screwdriver or other, similar tool to enable further tightening of the turnbuckle mechanism as needed. As a result, the hand guard attachment system 10 according to the principles of the present invention provides for a self-indexing, free floating forward grip or hand guard that can be easily mounted to and removed from the upper receiver of a firearm without having to remove the barrel mounting nut or barrel assembly and which further is easily operable by persons in the field without necessarily requiring additional tooling for engagement and operation of the hand guard attachment system.

Figure 9A:
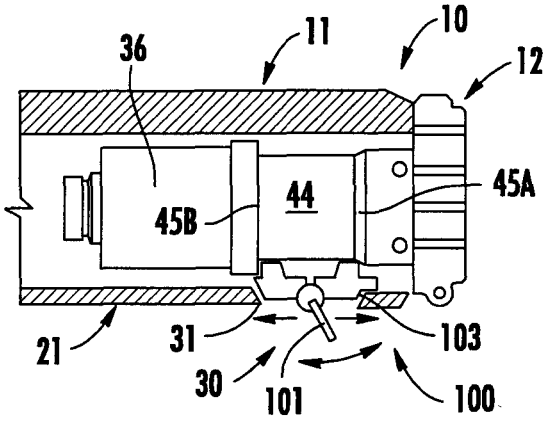
FIGS. 9A-9C illustrate additional, alternative tensioning assemblies for use in a hand guard attachment system, according to embodiments of the disclosure.
Figure 9C:
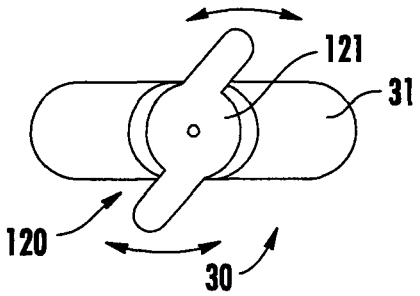
Figure 9B:
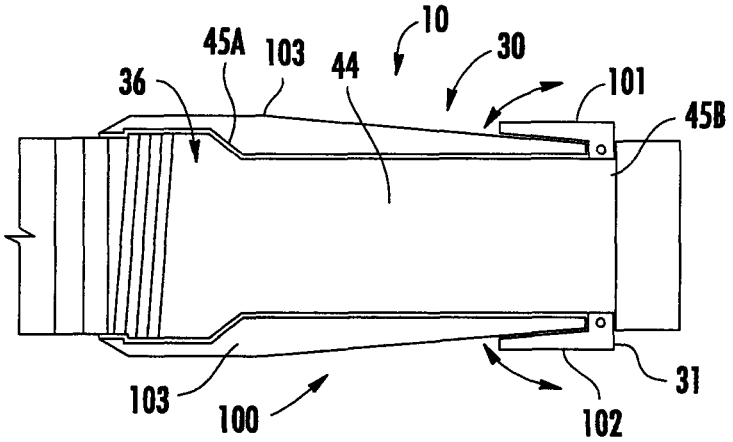

In addition, other alternative attachment and tensioning assemblies 30 (FIGS. 9A-9C) further can be used in the hand guard attachment system 10 according to the principles of the present invention for securing the hand guard in frictional or biased engagement with the barrel nut and/or upper receiver of the firearm to which the hand guard is being attached. For example, as shown in FIGS. 9A-9B, a cam system 100 could be provided, with one or more cam levers 101/102 that engage the hand guard body and which can be moved into engagement with one or both of the upstream and downstream edges of the recess of the barrel nut so as to draw the hand guard into engaging contact with the barrel nut, either directly or indirectly. Such a cam system further could include one or more linkages or braces 103 (FIGS. 9A-9B) that are moveable laterally into engaging contact with the upstream and downstream edges of the barrel nut recess, and further can include portions that engage and ride along the inner surface of the body of the hand guard so as to draw the hand guard vertically against the barrel nut.

As still another alternative tensioning assembly, a toggle locking system 120 (FIG. 9C), or a ratcheting system could be used, including an actuating tab or knob 121 received within the slotted opening 31 of the body of the hand guard and which can be rotated into engagement with the hand guard and barrel nut surfaces, and/or can engage a spring biased ratchet mechanism, which engages the edges of the recess of the barrel nut, while at the same time drawing the hand guard against the barrel nut. Still further, multiple tensioning assemblies, including multiple cam locking levers, turnbuckle mechanisms, ratchet mechanisms, and/or combinations thereof, also can be used in accordance with the principles of the present invention.

In addition, as illustrated in FIGS. 1-4A and 10A-10D, the firearm receiver 12 also can be provided with a reduced profile stock assembly 60, including a stock/butt stock portion 60A adapted to engage against the shoulder of a shooter. The stock portion 60A can include a recoil pad or cushioning surface, in addition to being configured to fit comfortably against the shoulder of a shooter for spreading the recoil force. The stock 60A further generally will be mounted on an integrated sliding rail system 61 bedded within the upper receiver 12 and/or lower receiver 62 of the firearm so as to be moveable between a closed, retracted position as shown in FIG. 1, and an extended, open position, shown in FIG. 10A.

The rail system 61 generally will include a pair of spaced, rigid rails 63, located on opposite sides of the upper and/or lower receiver of the firearm F. The rails 63 each will include a first or distal end 64 bedded or otherwise connected to the stock portion 60A so as to provide support for the stock portion when in an extended condition, and a second or proximal end 65 that is received and slides along an embedded guide recess 66 formed along the upper and/or lower receivers 12 and 62 of the firearm, as indicated in FIGS. 1 and 10A-10D. The guide rails 63 (FIG. 10B) can be engaged within their respective guide recesses 66, generally being at least partially enclosed or otherwise engaged within the recesses along upper and lower edges 67A and 67B thereof to provide a smooth guidance track for enabling the stock to be extended and retracted without twisting or disorientation of the stock.

Figure 10A:
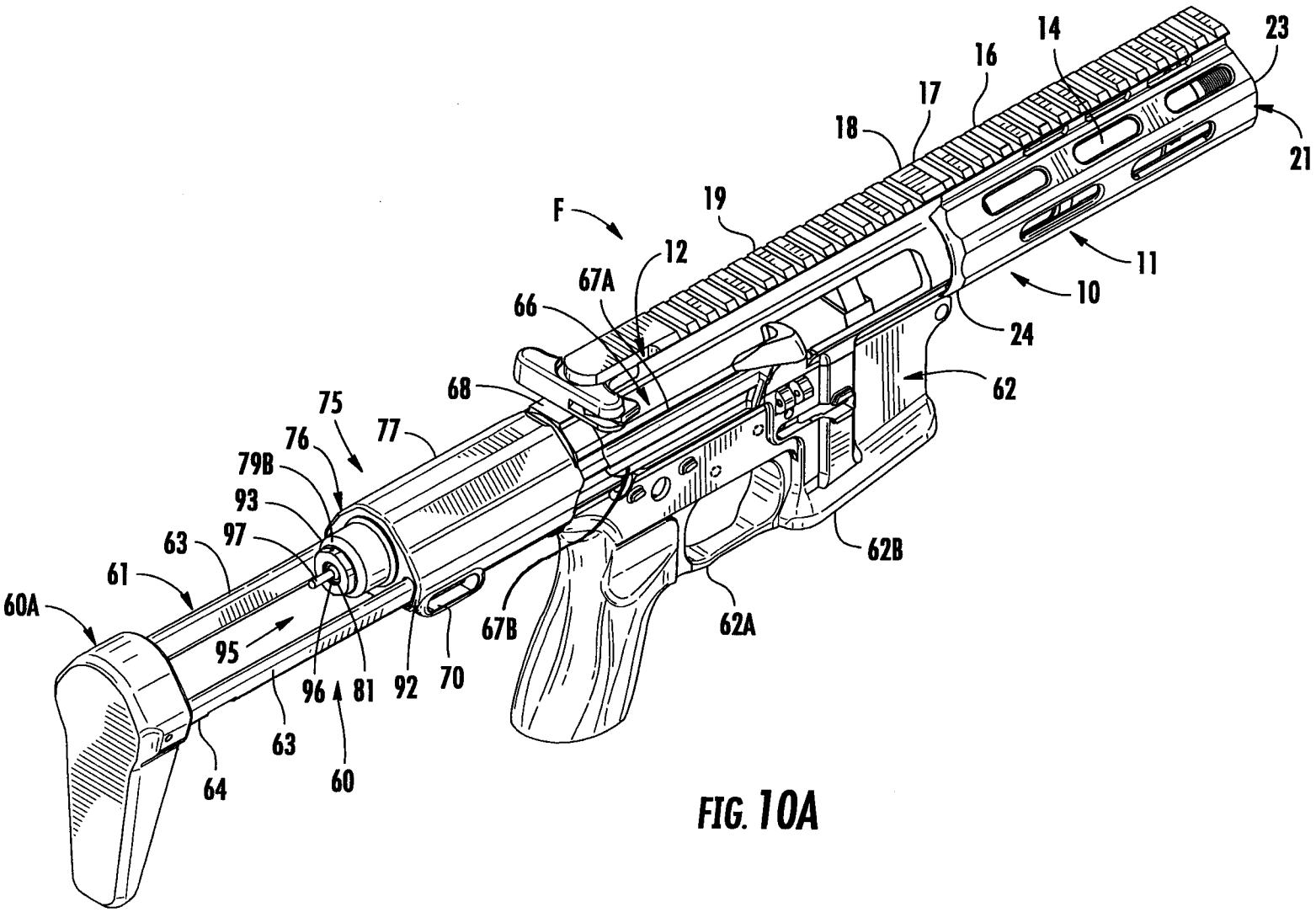
FIGS. 10A-10D illustrate a reduced profile stock system, according to embodiments of the disclosure.
Figure 10B:
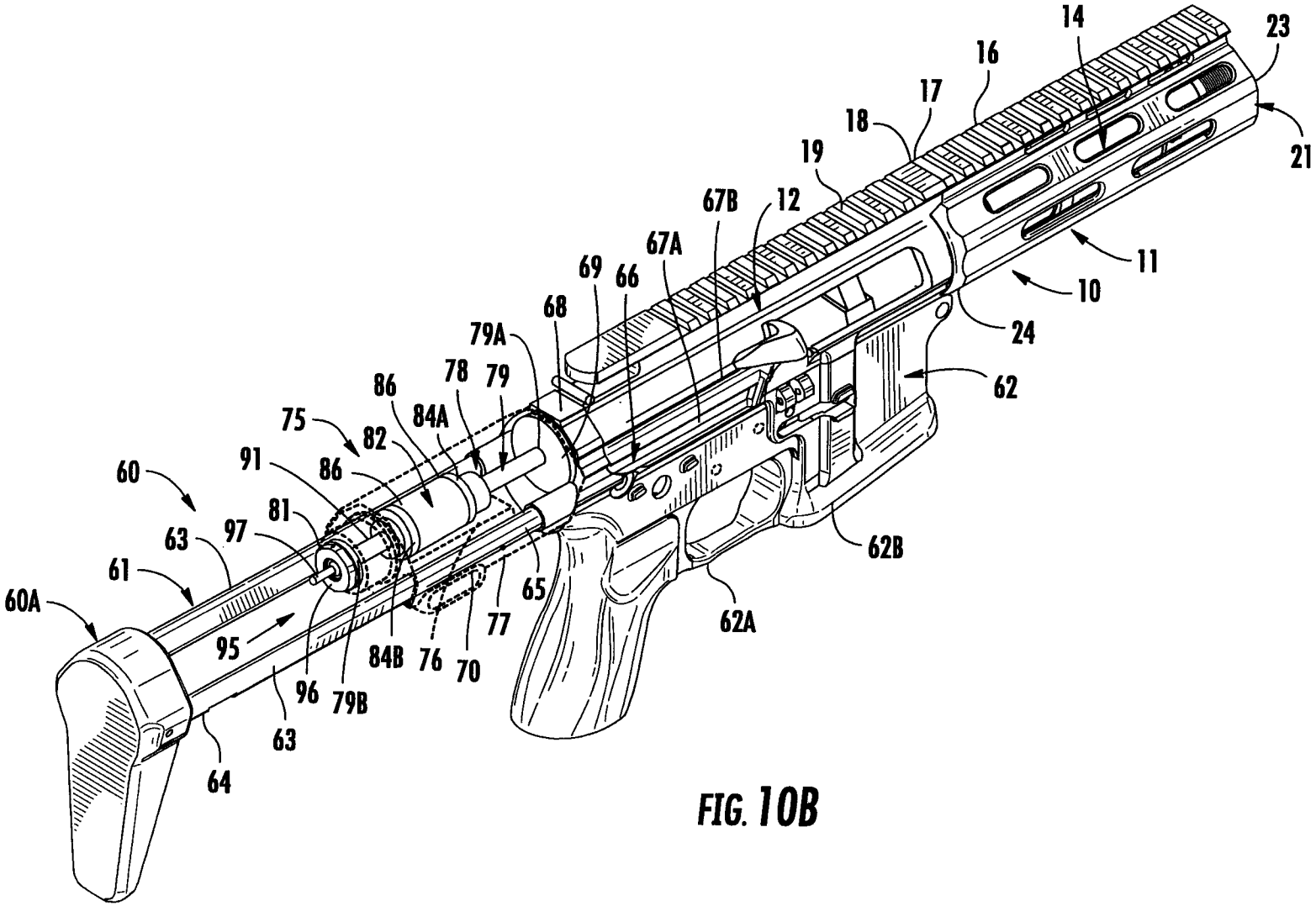
Figure 10C:
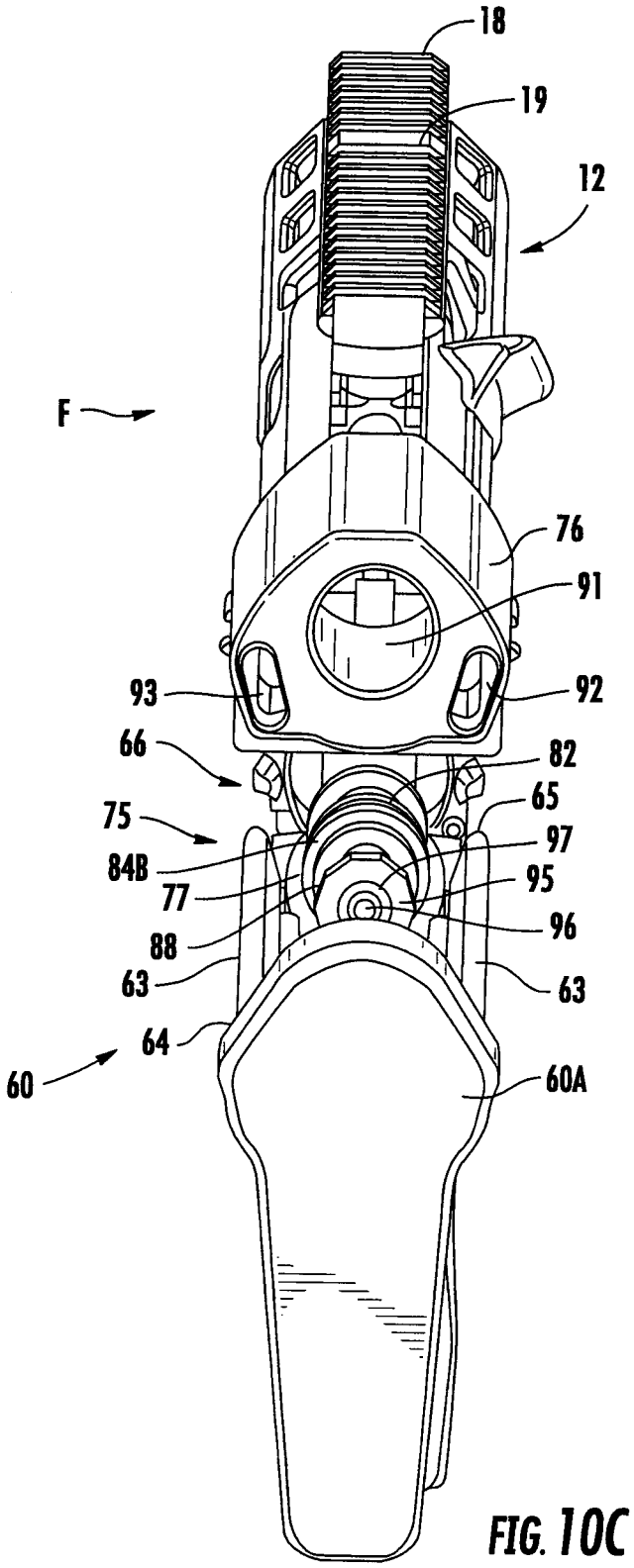
Figure 10D:
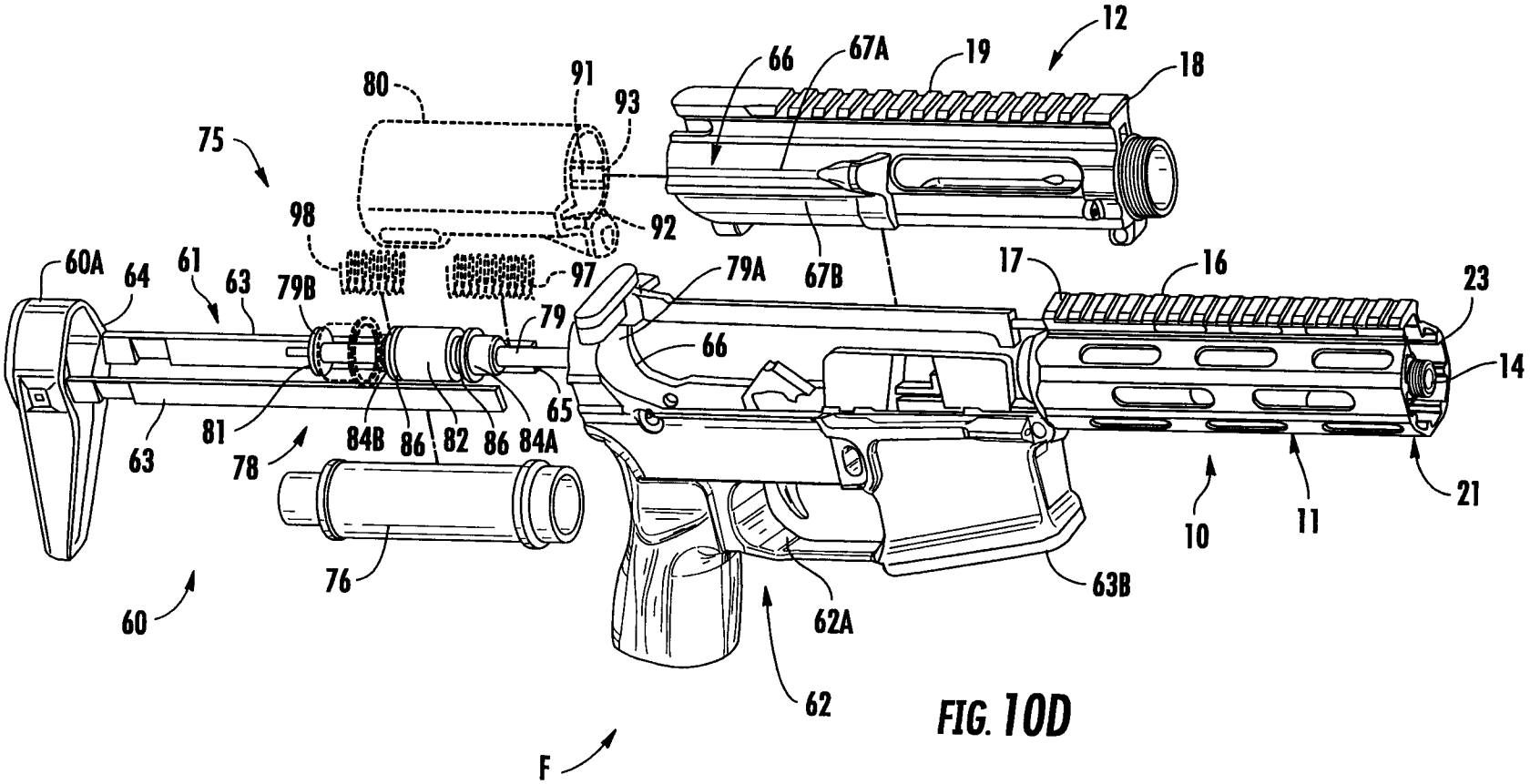

As further generally illustrated in FIGS. 10A, 10B and 10D, the lower receiver 62 generally can be formed with an integrated trigger guard 62A and magazine well 62B and further generally will include an upwardly projecting rearward section 68 having an opening 69 (FIGS. 10B and 10D) defined therethrough. This upwardly projection section 68 of the lower receiver 62 is adapted to mate with the upper receiver 12 on a forward side thereof, as indicated in FIGS. 10A, 10B and 10D, and is engaged and mates with a buffer tube assembly 75 on a rearward or back side portion, as indicated in FIGS. 10A and 10B.

As illustrated in FIGS. 10A-10D, the buffer tube assembly 75 generally includes a buffer tube 76 enclosed within a housing 80 and which further receives a buffering mechanism 78 (FIGS. 10B, 10D) therein. As illustrated in FIGS. 10B and 10D, the buffering mechanism 78 generally includes a central guide rod 79 having a first end 79A that can be coupled to the bolt and/or the bolt carrier of the firearm, and a rearward end 79B that generally extends to the rear end of the buffer tube housing, terminating at an expanded plate or nut 81 as shown in FIGS. 10B-10D. A counterweight 82 is slidably mounted along the guide rod, located between a pair of bearings 84A/84B. The counterweight 82 typically can be made from steel and helps slow the rearward translation of the bolt of the firearm during cycling. In addition, gaskets, such as shown at 86, can be placed between the ends of the counterweight 82 and the opposed facing surfaces of the bearings 84A and 84B, as illustrated in FIG. 10D. The gaskets can be made from a resilient, compressible material so as to provide further cushioning effect for the rearward movement of the bolt against the buffering mechanism.

A pair of counter wound springs 87 and 88 (FIG. 10D) further generally will be received along the guide rod 79, with the first spring 87 being positioned in front of the first or foremost bearing, and the second or rearmost spring 88 being positioned between the end nut of the guide rod and the rear bearing. The springs 87 and 88 can be torsion or counter wound springs, although other resilient or dampening materials also can be used, and will provide r a dampening or cushioning effect of the bolt against the counterweight and further against the end nut 81 of the guide rod 79 of the buffer tube assembly 75. The bolt carrier of the firearm also can be of a reduced length and/or weight to enable a reduction in size of the upper end or lower receiver of the firearm.

During operation of the firearm, as the bolt carrier translates rearwardly, carrying the bolt along its rearward path of travel, the travel of the bolt is dampened or slowed by the first spring 87 of the buffer mechanism 78, which slows or dampens the rearward movement of the bolt against the steel counterweight 82. The counterweight 82 thereafter is further translated rearwardly along its guide rod 79 with the continued rearward translation or movement of the bolt. The added weight (i.e., and associated inertia) of the counterweight 82 sliding along the guide rod 79 further helps slow the rearward movement of the bolt, which further rearward movement is additionally cushioned and slowed or dampened by the second or rearward spring 88 of the buffer mechanism 78. As a result, the bolt movement is slowed and progressively stopped, rather than providing a hard stop against which the bolt engages so as to provide for an anti-bolt bounce buffering effect. The return action of the springs 87, 88 drives the bolt forwardly to cycle the weapon. The buffer tube assembly 75 and buffer mechanism 78 thus enables consistent cycling of the bolt assembly of the firearm F without undue shock or jarring due to the stopping of the bolt, while further enabling a reduction in length and/or weight of the bolt carrier and its operational cycle.

As further illustrated in FIGS. 10B-10D, the housing 80 of the buffer tube assembly 75 generally is formed with an internal recess or bore 91 and through which the buffer tube 76, with the buffering mechanism 78 therein, is received. In addition, the housing 80 further generally will include spaced slots 92 and 93 (FIGS. 10C & 10D) formed on opposite sides of the housing 80 and oriented/aligned with the rails 63 of the stock assembly 60. As a result, as indicated in FIGS. 10A and 10B, as the stock 60A of the stock assembly is moved between its expanded and retracted positions, the rails 63 will slide along their respective recesses 92 and 93 formed in the housing 80 of the buffer tube assembly 75 and further will be guided through and along their guide recesses 66 formed along each side of the firearm F along or adjacent the junction between the upper and lower receivers 12, 62. The housing 80 of the buffer tube assembly 75 thus provides further support and rigidity to the rails 63 during movement and when the stock system 60 is in its extended position, additionally helping guide the forward ends 65 of the rails 63 into and along their respective guide slots formed in the upper and lower receivers 12, 62.

As shown in FIGS. 10C-10D, the stock assembly further includes a retention mechanism 95 that includes one or more counter-wound springs that bias the stock portion 60A toward an extended or open position. The spring(s) is received within an opening 96 formed in the rear end of the guide rod 79. A guide pin 97 is biased by the spring into engagement with the stock. The action of the spring biased guide pin 97 against the stock portion 60A tends to reduce/retard vibration when the stock is in a locked position and further helps hold the stock portion 60A in its closed, retracted, and locked position until released. As shown in FIG. 1, a release button 70 can be provided along the stock assembly 60, such as at a rear portion of the housing 80 of the buffer tube assembly 75. The release button 70 can release a catch or other means of the stock retention or locking mechanism engaging the rails 63, which can include notches or catch portions at spaced-apart locations therealong as indicated in FIGS. 10B and 10D, to enable the stock portion 60A to be moved rearwardly by the user, or under the action of springs or other similar mechanisms to its extended, open position. The stock assembly 60 further can be provided with mechanisms to enable the locking of the stock at varying positions/distances from the upper and lower receivers of the firearm. The spring pressure acting upon the stock portion 60A by the guide pin 97 further helps prevent premature deployment of the stock portion 60A until the retention or locking mechanism therefor is fully disengaged.

The foregoing description generally illustrates and describes various embodiments of the present invention. The examples given above are merely illustrative and are not meant to be an exhaustive list of all possible designs, aspects, applications or modifications of the present disclosure. It will, therefore, be understood by those skilled in the art that while the present disclosure has been described in terms of exemplary aspects, the present disclosure can be practiced with various changes and modifications which can be made to the above-discussed construction of the present invention without departing from the spirit and scope of the invention as disclosed herein, and that it is intended that all matter contained in the above description or shown in the accompanying drawings shall not to be taken in a limiting sense.

Furthermore, the scope of the present disclosure shall be construed to cover various modifications, combinations, additions, alterations, etc., to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention.

The invention claimed is:

1. A firearm, comprising:

an upper receiver having a bolt assembly therein;

a barrel coupled to the upper receiver by a barrel nut;

a hand guard releasably attached to the upper receiver in a floating arrangement with respect to the barrel, the hand guard comprising a proximal end configured to engage the upper receiver; and a tensioning assembly mountable between the hand guard and the barrel nut, and operable so as to be selectively moveable into an engaged position applying a biasing force against the hand guard and the barrel nut sufficient to substantially affix the hand guard in its floating arrangement with respect to the barrel, for releasably attaching the hand guard to the firearm, wherein the tensioning assembly comprises a turnbuckle mechanism comprising:

a rotatable spindle having opposed threaded shanks extending therefrom; and engaging tabs mounted on respective ones of the opposed threaded shanks, the engaging tabs moveable between extended and retracted positions relative to the rotatable spindle in response to rotation of the rotatable spindle such that the engaging tabs are moved into and out of engagement with the hand guard and barrel nut.

2. The firearm of claim 1, further comprising:

a reduced profile stock system interfaced with the upper receiver, the stock system comprising a stock and at least one rail attached to the stock and slideably received along a guide recess formed within the upper receiver.

3. The firearm of claim 2, further comprising a lower receiver, a buffer tube assembly mounted to a rear portion of the lower receiver and including a buffer tube coupled to the bolt assembly for dampening recoil movement of the bolt assembly, and a housing surrounding the buffer tube and having a slot formed therethrough adapted to receive and guide the at least one rail of the stock system into the guide recess of the upper receiver when the stock system is moved to a retracted position.

4. The firearm of claim 1, wherein the barrel nut comprises an annular recess formed thereon about a central axis of the barrel nut, the annular recess configured to engage the tensioning assembly.

5. The firearm of claim 1, wherein the hand guard further comprises at least one interfacing tab extending longitudinally from the proximal end of the hand guard and configured to engage a corresponding surface feature of the upper receiver to put the hand guard against the firearm.

6. The system of claim 5, wherein the at least one interfacing tab comprises inwardly projecting edges having an inner diameter approximately equal to an outer diameter of the upper receiver.

7. A firearm, comprising:

an upper receiver;

a barrel coupled to the upper receiver;

a hand guard releasably mountable to the upper receiver with the barrel extending therethrough, the hand guard comprising a body having a distal end and a proximal end, the proximal end having an interfacing tab configured to engage a forward end of the upper receiver in a bearing engagement and guide the hand guard into a substantially aligned, mating engagement with the upper receiver; and a tensioning assembly received between the upper receiver and a portion of the hand guard, the tensioning assembly configured to be movable into a position engaging the hand guard and the receiver and selectively operable for applying a biasing force against the hand guard and the receiver sufficient to substantially mount the hand guard in abutting engagement against the receiver, wherein the tensioning assembly comprises a turnbuckle mechanism comprising:

a rotatable spindle having opposed threaded shanks extending therefrom; and engaging tabs mounted on respective ones of the opposed threaded shanks, the engaging tabs moveable between extended and retracted positions relative to the rotatable spindle in response to rotation of the rotatable spindle such that the engaging tabs are moved into and out of engagement with the hand guard and a barrel nut of the firearm.

8. The system according to claim 7, wherein the hand guard comprises a substantially cylindrical body having at least one retention slot formed therethrough, the retention slot configured to be engaged with the tensioning assembly to secure the hand guard to the forward end of the firearm.

9. The firearm of claim 8, further comprising a barrel nut mounted adjacent a forward end of the upper receiver rearward of the retention slot, wherein the tensioning assembly engages the hand guard along the retention slot and engages the barrel nut to form a releasable connection therebetween.

* * * * *